United States Patent [19]

Verseef

[11] Patent Number: 5,048,207

[45] **Date of Patent: * Sep. 17, 1991**

[54] ADJUSTABLE DISCHARGE WING PLOW

[75] Inventor: Jan H. Verseef, Clayton, N.Y.

[73] Assignee: Frink America, Inc., Clayton, N.Y.

[ * ] Notice: The portion of the term of this patent subsequent to Jun. 13, 2006 has been disclaimed.

[21] Appl. No.: 492,961

[22] Filed: Mar. 13, 1990

[51] Int. Cl.[5] ..... E01H 5/06

[52] U.S. Cl. ..... 37/281; 37/279; 37/266; 37/197

[58] Field of Search ..... 37/281, 279, 266, 232, 37/233, 234, 197

[56] References Cited

U.S. PATENT DOCUMENTS

| | | | |
|---|---|---|---|
| 3,604,131 | 9/1971 | Bogenschutz | 37/232 |
| 3,808,714 | 5/1974 | Reissinger et al. | 37/233 |
| 4,019,587 | 4/1977 | Meisel, Jr. | 37/279 X |
| 4,216,833 | 8/1980 | Fezatt et al. | 37/283 X |
| 4,385,458 | 5/1983 | Pitti | 37/281 |
| 4,552,226 | 11/1985 | Platter | 37/279 X |
| 4,635,387 | 1/1987 | Häring | 37/232 |
| 4,744,159 | 5/1988 | Houle | 37/281 X |
| 4,803,790 | 2/1989 | Ciula | 37/266 |
| 4,837,951 | 6/1989 | Verseef | 37/281 X |

FOREIGN PATENT DOCUMENTS

| | | | |
|---|---|---|---|
| 46436 | 6/1976 | Japan | 37/233 |
| 17543 | 4/1981 | Japan | 37/233 |

*Primary Examiner*—Dennis L. Taylor
*Assistant Examiner*—J. Russell McBee
*Attorney, Agent, or Firm*—Wall and Roehrig

[57] ABSTRACT

A wing plow for use with a main plow has a scraper blade and a fixed moldboard mounted on the top edge of said scraper blade for the inner portion of the wing plow and a flexible moldboard sheet member joined to said rigid moldboard section and extending to the discharge end of said wing plow. An adjusting arm and hydraulic cylinder are connected to the top corner of the outer end of the flexible sheet to independently position and contour the discharge end of said sheet to control the discharge of material from the wing plow.

9 Claims, 2 Drawing Sheets

ADJUSTABLE DISCHARGE WING PLOW

BACKGROUND OF THE INVENTION

This invention relates to a multi-plow apparatus having a central plow and one or more wing plows for clearing snow from a roadway, parking area or the like. More particularly this invention is directed to the control and placement of snow, being discharged through the central plow to the wing plow and on to the disposal area.

Most conventional moldboards for plows are formed from metal into a desired convex arcuate shape depending upon the use of the particular plow. In some cases the moldboard is involuted to provide a flared discharge at one end, for casting snow to one side or the other of the propelling vehicle. More recently as shown in, U.S. Pat. No. 4,837,951 to Verseef and U.S. patent application Ser. No. 389343 filed Aug. 3, 1989, both assigned to the common assignee of the present application, a device and method have been disclosed for controlling the contour of the plow moldboard to change the direction of discharge and to control the placement of snow, as it is discharged from the plow blade and moldboard assembly.

These more recent, adjustable moldboard plows have proved to be very satisfactory and to improve the efficiency and utility of the plows so equipped in the disposal and placement of the plowed snow. The ability to control the snow stream as it is discharged has improved the flexibility of plowing equipment tremendously.

SUMMARY OF THE INVENTION

It is therefore, an object of the present invention to provide a wing plow for use in a multi-plow system with a controllable discharge chute capability to provide control of the displaced snow as it moves through the system. It is another object of the invention to provide a flexible moldboard discharge chute assembly for wing plows that can be simply and easily changed to control the placement of snow discharged therethrough. It is a still further object of the present invention to provide a means for bundling the snow stream and directing the discharge of the snow stream from the main plow to and through a wing plow, so as to improve the safety, efficiency and utility of a multiple plow system.

These and other objects of the present invention are attained by securing a flexible moldboard sheet to the outer upper edge of a scraper blade wing plow at the discharge end thereof, and selectively positioning the upper edge of said flexible moldboard sheet portion to direct the discharge of snow flowing through the wing plow.

BRIEF DESCRIPTION OF THE DRAWINGS

For better understanding of these and other objects of the present invention reference shall be made to the following detailed description of the invention which is to be read in association with the accompanying drawings wherein.

DETAILED DESCRIPTION OF THE INVENTION

Figure 1:
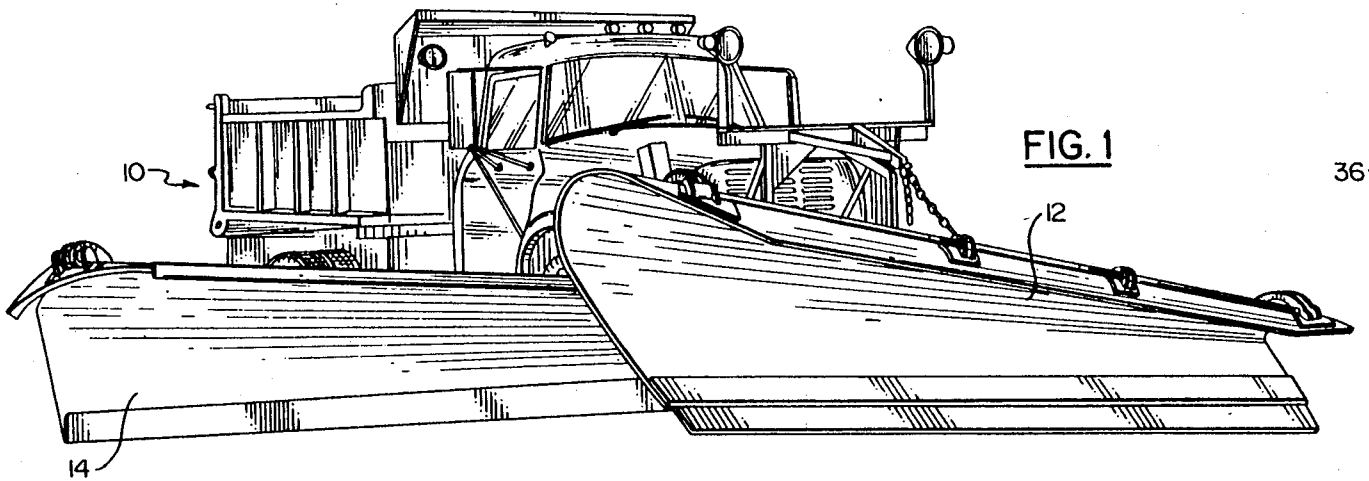
FIG. 1 is a perspective view of a multi-plow assembly having a wing plow in accordance with the present invention.

Referring now to FIG. 1 there is shown a truck 10, having a central plow 12 mounted at the front end of the truck, and a wing plow 14, mounted on the right side of the truck. Plow 12, is shown as being constructed in accordance with the above referred to U.S. Pat. No. 4,837,951. In this configuration the plow 12 is angled for discharge of snow to the right and the wing plow 14, is disposed to carry the snow discharged from plow 12 further to the right and place it in the desired disposal area, to the extreme right of the truck 10.

In a preferred embodiment of the present invention the central plow 12 is contoured to a "hooded" condition for the particular type of snow being plowed so that the snow stream is folded over and bundled into a compact laterally moving stream. This stream is directed to the wing plow which in turn is contoured to a "hooded" condition to fold and bundle the scraped snow from the wing plow into the stream from the central plow and to continue to bundle the total snow stream until it is discharged to the desired deposit zone.

This "bundling" greatly reduces, if not eliminates unwanted blowing of snow caused by the plowing operation.

Figure 3:
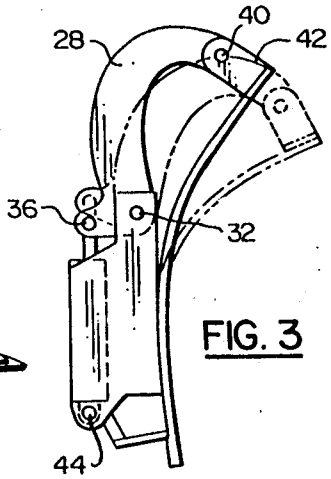
FIG. 3 is an end view from the right-hand end of FIG. 2.
Figure 2:
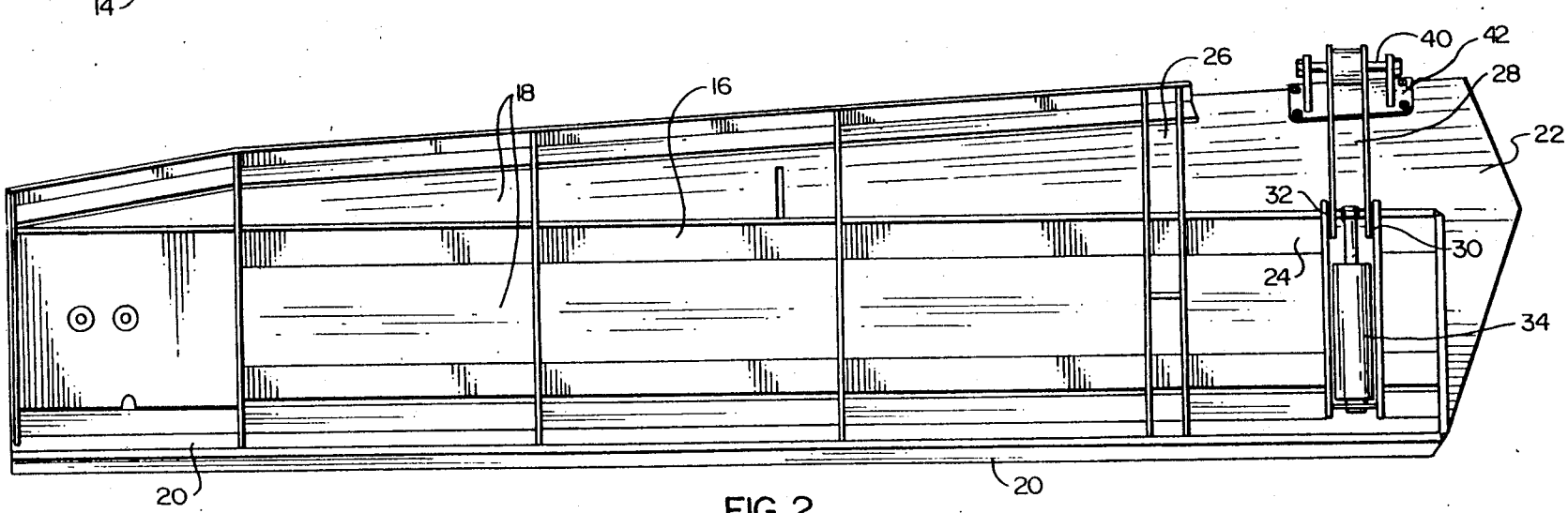
FIG. 2 is a rear elevational view of the wing plow scraper blade and moldboard assembly of the present invention.

As may be seen in FIG. 2 wing plow 14, has a multi-ribbed frame portion 16, upon which is mounted the moldboard 18, and a scraper blade assembly 20, along the bottom thereof. This construction has been standard in the industry for some period of time and by itself does not form a part of the present invention. As may be seen further by looking at FIGS. 2, 3, and 4, at the right-hand end of the wing plow (FIG. 2), the top framework has been eliminated and a flexible moldboard portion 22 added. Flexible moldboard 22 is mounted along the bottom to the frame member 24, and along its left-hand edge in FIG. 2 to frame rib 26, and the moldboard 18. Also, mounted on the frame 24, at the right-hand end of FIG. 2 is a bracket 30. Adjusting arm 28, is hingedly mounted in bracket 30, at pin 32, so that the arm can be moved about the horizontal pin 32 in the vertical plane. The bracket 30, may be mounted for movement about a vertical axis by a pin that is secured to the frame member 24. This bracket 30 also has pivotally mounted therein the cylinder 34 at pin 44. Piston rod 35 is pivotally joined to the proximal end of arm 28 at 36, for movement from the position shown in full lines in FIG. 3 to the position shown in dotted lines therein. The distal end of arm 28 can be connected through a pin 40, mounted in a bracket 42, which is fixed to the outer extremity of the flexible moldboard portion 22.

Figure 4:
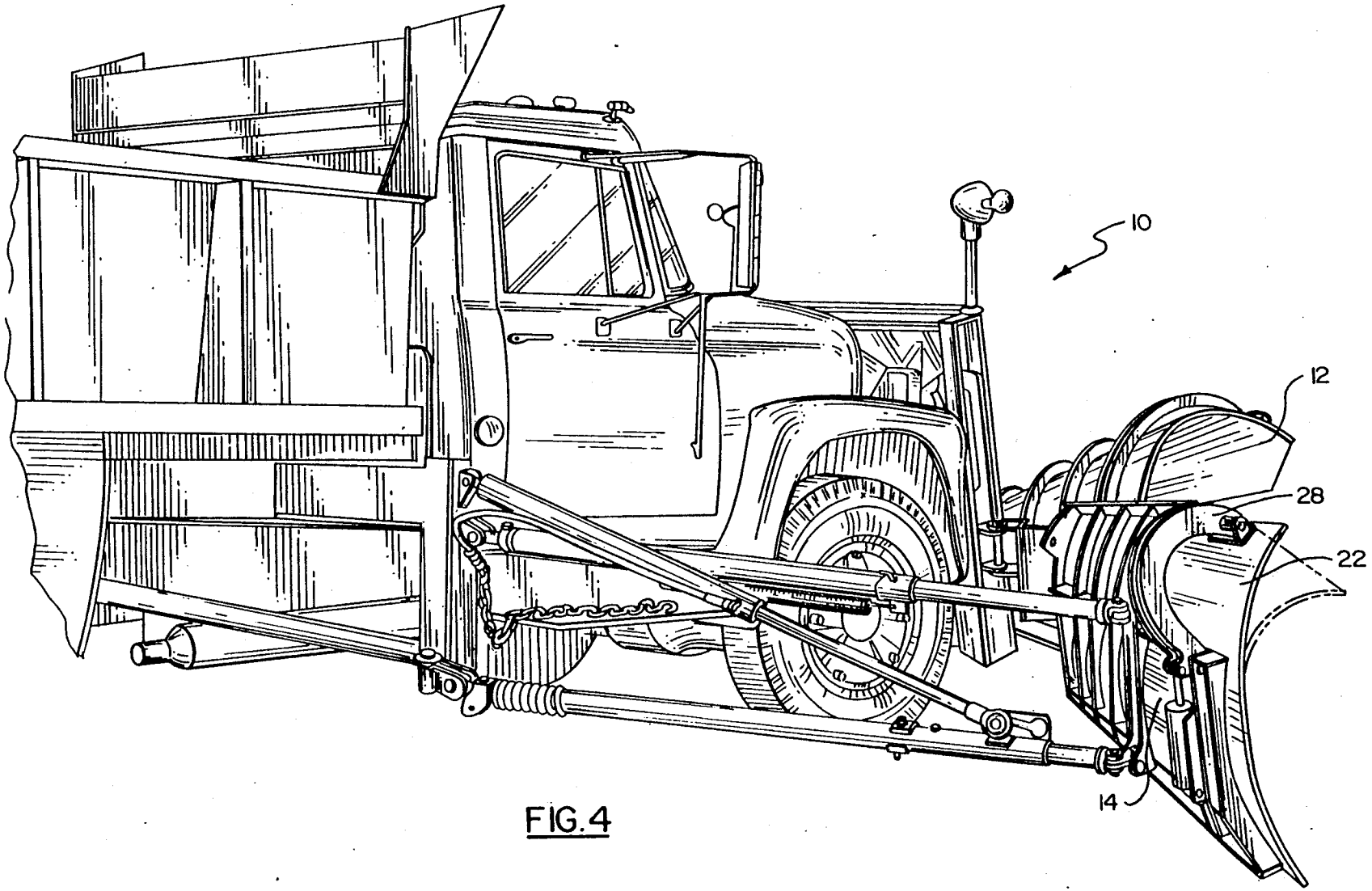
FIG. 4 is a perspective view of the apparatus of FIG. 1 taken from the right rear of the truck on which the plows are mounted, showing the mounting arrangement for the wing plow and the flexible moldboard portion.

Thus as may be seen in FIG. 4, when the cylinder 34 is actuated the adjusting arm 28 is pivoted about the hinge pin 32, folding the flexible portion of the moldboard 22, forward and over into a much sharper arcuate discharge chute to bundle and direct the snow flowing through the blade 14, more directly onto the ground. Alternatively if the cylinder 34 is in the retracted position the moldboard is in a more nearly straight up and down condition and allows the snow to be discharged at a greater distance and in a more open fashion from the blade 14.

In plowing snow one of the major practical problems is the blowing of snow kicked up by the plow itself to the point where the truck disappears in a cloud of snow. Literally, a following vehicle frequently can not see a snow plow with conventional plows.

According to the present invention by using the plows of my above referenced patent and application and properly contouring the central and wing plows, the stream of laterally displaced snow may be bundled over and controlled to limit this dispersed blowing. By "hooding" the flexible moldboard of the central and wing plows a controlled discharge close to the ground is obtained, which greatly reduces blowing and deposits the snow on the ground in the desired deposit zone.

As will be obvious to those skilled in the art, this allows the operator of the vehicle when plowing snow to cause not only, the main plow 12 to be contoured for the most efficient lateral displacement of the snow, but also permits the wing plow 14, to be similarly "hooded" to minimize blowing and discharge the snow precisely where it is desired, under a wide variety of types of snow, weather conditions and so forth. The wing 14, with the flexible moldboard 22 controlled in this manner is a safer, more efficient and effective tool in the plowing of snow, whether used to clear a wider path on a flat area or for leveling and cutting back of large drifts and so forth. There is thus provided a much more effective and flexible tool for use in the battle against large accumulations of snow.

While this invention has been explained with reference to the structure disclosed herein, it is not confined to the details as set forth in this application, it is intended to cover any modifications and changes as they come within the scope of the following claims:

What is claimed is:

1. In a snow plow of the type having a main central plow and one or more wing plows, an adjustable moldboard wing plow for directing the discharge of snow therefrom comprising:

a main frame portion;

an elongated scraper blade means mounted on the bottom of said main frame portion;

an arcuate moldboard mounted on the top of said blade means and extending from the inner end thereof toward the discharge end of said wing plow;

a flexible moldboard sheet mounted on the top of said blade means extending from said arcuate moldboard to the discharge end of said wing plow to form a flexible, adjustable discharge chute;

an adjusting arm pivotally mounted on said main frame and connected to the upper edge portion of said flexible moldboard sheet;

actuating means for selectively adjusting the position of said arm to change the contour of said sheet so as to direct the discharge and placement of snow laterally displaced by said main and wing plows.

2. A device as described in claim 1 wherein said actuating means comprises a hydraulic cylinder pivotally fixed at one end to said main frame portion and at the other end to said adjusting arm.

3. A device as described in claim 2 wherein said hydraulic cylinder is mounted to said main frame for pivotal movement about a vertical axis, in addition to the pivotal mounting means at each end thereof;

whereby as said cylinder is extended and the flexible moldboard sheet is curved;

the adjusting arm will pivot in the mounting to allow continued extension of said cylinder means.

4. A device as described in claim 1 wherein said flexible moldboard sheet comprises between 20 and 35% of the overall length of said wing plow.

5. In a snow plow of the type having a main plow and one or more wing plows, each wing plow having a main frame and an elongated scraper blade means mounted on said main frame, an arcuate moldboard comprising in combination;

a first arcuate moldboard mounted on top of a portion of said blade means;

a second arcuate moldboard having a flexible sheet portion mounted on top of said blade means adjacent said first moldboard;

said first and second moldboards combining to extend along the entire length of said scraper blade means; and actuating means for selectively adjusting the curvature of said flexible sheet portion of said second moldboard.

6. A device as described in claim 5 wherein said flexible moldboard sheet portion comprises at least the outer moldboard portion of said wing plow and the arcuate moldboard portion comprises the inner portion of said wing plow.

7. A device as described in claim 6 wherein said flexible moldboard sheet portion comprises between 20% to 35% of the overall length of said wing plow.

8. A device as described in claim 6 wherein said flexible moldboard sheet portion comprises 25% of the overall length of said wing plow;

9. In a multiple snow plow system of the type having a central plow and one or more wing plows, the method of laterally displacing snow plowed from a surface to a deposit zone which comprises:

scraping the snow from the surface to be plowed;

bundling the scraped snow over into a concentrated stream;

directing the bundled stream of snow from a central plow to a wing plow;

bundling the wing plow scraped snow over and into the central plow snow stream; and directing the combined and bundled snow stream from the wing plow to the desired discharge zone so that the lateral displacement of the scraped snow is controlled to substantially reduce blowing snow caused by the plowing operation.

* * * * *